US007431706B2

(12) United States Patent
Louis

(10) Patent No.: US 7,431,706 B2
(45) Date of Patent: Oct. 7, 2008

(54) GENERALLY TRIANGULAR-SHAPED MASSAGE TOOL WITH THREE DIFFERENT CONTACT ELEMENTS

(76) Inventor: John G. Louis, 269 Latrobe Ave., Northfield, IL (US) 60093

( * ) Notice: Subject to any disclaimer, the term of this patent is extended or adjusted under 35 U.S.C. 154(b) by 372 days.

(21) Appl. No.: 11/159,037

(22) Filed: Jun. 22, 2005

(65) Prior Publication Data

US 2006/0293619 A1 Dec. 28, 2006

(51) Int. Cl.
*A61H 39/04* (2006.01)
*A61H 7/00* (2006.01)

(52) U.S. Cl. ..... 601/135; 601/137

(58) Field of Classification Search ..... 601/135, 601/137, 1, 46, 72, 80; D24/200, 214
See application file for complete search history.

(56) References Cited

U.S. PATENT DOCUMENTS

| | | | | | |
|---|---|---|---|---|---|
| 3,545,434 | A | * | 12/1970 | Woodruff | 601/137 |
| 4,483,328 | A | | 11/1984 | Wolocko | |
| D304,748 | S | * | 11/1989 | Bowers | D21/684 |
| 5,382,222 | A | | 1/1995 | Yih-Jong | |
| D373,197 | S | | 8/1996 | Schepper | |
| D374,484 | S | | 10/1996 | Haynes | |
| D375,166 | S | | 10/1996 | Goulding-Thompson et al. | |
| 5,624,385 | A | | 4/1997 | Hwang | |
| D386,879 | S | * | 11/1997 | Daniels | D24/214 |
| 6,010,469 | A | | 1/2000 | McAtee | |
| 6,077,239 | A | * | 6/2000 | Lin | 601/137 |
| 6,241,694 | B1 | | 6/2001 | Goulding-Thompson et al. | |
| 6,267,738 | B1 | | 7/2001 | Louis | |
| D456,909 | S | | 5/2002 | Szabo | |
| 2001/0051778 | A1 | * | 12/2001 | Sevier et al. | 601/137 |
| 2004/0230147 | A1 | | 11/2004 | Fretterd | |
| 2004/0249324 | A1 | | 12/2004 | Louis | |
| 2005/0159689 | A1 | * | 7/2005 | Olson | 601/135 |

OTHER PUBLICATIONS

Internet web page of the Pressure Positive Co. at "www.pressurepositive.com/prod_massage/", Jun. 2005.
Internet web page of The Massage Warehouse at "www.massagewarehouse.com/Manual+Tools/id=293/category.jthml" Jun. 2005.
Accu-Flex Reflexology and Body Massage Tool (Item #5560017907) entered on Feb. 21, 2005, and indicating a sale on Feb. 22, 2005, on the Internet at the "www.ebay.com" web site.

* cited by examiner

*Primary Examiner*—Danton DeMille
(74) *Attorney, Agent, or Firm*—John C. Shepard

(57) ABSTRACT

A handheld massage tool includes a body with at least three contact elements spaced circumferentially therearound for engaging a recipient of therapy. The body has shoulder segments extending between adjacent contact elements enabling the user to grip the tool and manipulate a non-adjacent, opposed contact element. The contact elements may take the form of a narrow point, a broad point, or a wedge. To aid in massage therapy, the massage tool has significant weight, has an elastomeric or similar coating providing a non-abrasive outer surface and is formed with rounded edges and suitably curved contours.

1 Claim, 1 Drawing Sheet

GENERALLY TRIANGULAR-SHAPED MASSAGE TOOL WITH THREE DIFFERENT CONTACT ELEMENTS

BACKGROUND OF THE INVENTION

1. Technical Field

The invention pertains to a massage tool and, more particularly, to a hand-sized massage tool having a plurality of differing elements for applying a localized force and/or pressure to the person receiving massage therapy treatment.

2. Background Art

Therapists apply various techniques when treating an individual, dependant upon the condition of the individual. Some techniques can require persistent application, which can be quite taxing on a therapist, especially therapists who provide treatment generally unassisted.

Some therapists have made use of various tools designed to more effectively and/or more easily apply various therapeutic techniques. Different tools, including the commonly used T-bar, have had varying degrees of success. Some tools may improve some aspects related to applying a particular therapy, while sometimes making other aspects worse. Other tools may fall short of the desired effect, or may be the victim of ever increasing demands that they were never intended to meet and/or address. Consequently, there is an ever increasing demand to develop more effective techniques, some of which may only be possible with an appropriate tool. Furthermore, there is a demand to increase the effectiveness of existing tools.

Several techniques require the targeted application of pressure and/or force. At least a couple of examples include muscle stripping, trigger point, friction, and effleurage. Furthermore, the addition of force to other types of therapies can sometimes improve their effectiveness. However, the persistent application of force can, in some instances, be taxing on a therapist. Consequently, techniques and/or tools, which can assist in the application of force or can more effectively apply an existing force can serve to relieve some of the strain on a therapist, when applying a particular technique.

Furthermore, tools which help combine the effective application of force with other therapies may also be beneficial. Still further, techniques or tools that help to eliminate other impediments to the application of an effective treatment, either to the recipient of the treatment, or the person applying the treatment, would additionally be beneficial.

BRIEF SUMMARY OF THE INVENTION

The present invention is directed to overcoming one or more of the problems as set forth above.

It is an object of the present invention to provide a compact, multifunctional tool that uses weight and form to emulate the human hand while performing massage therapy thereby reducing fatigue and the work required to be done by a therapist and increasing the sensation and effect on the therapy recipient.

In an exemplary embodiment of the present invention, a handheld, relatively rigid, massage tool is provided which has a body portion and a plurality of contact elements arranged circumferentially around the body portion for providing massage therapy to a recipient.

In one embodiment of the present invention, the body has shoulder segments extending between adjacent contact elements enabling the user to grip the tool and apply force to a non-adjacent, opposed contact element.

In another embodiment of the present invention, the massage tool is provided with significant weight to increase the overall mass of the massage tool so that the weight of the tool does much of the work with the user only applying additional force, tilting, turning, twisting or rotation necessary to complete appropriate treatment.

In a further embodiment of the invention the tool is shaped to fit naturally into the user's hand and has a non-abrasive outer surface of elastomeric material or similar coating.

In yet a still further embodiment of the present invention, the center of mass of the massage tool is located within its body portion to render the tool generally balanced and easier to use.

Numerous other advantages and features of the present invention will become readily apparent from the following detailed description of the invention and the embodiments thereof, from the claims and from the accompanying drawings.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings.

DETAILED DESCRIPTION OF THE PREFERRED EMBODIMENTS

Figure 1:
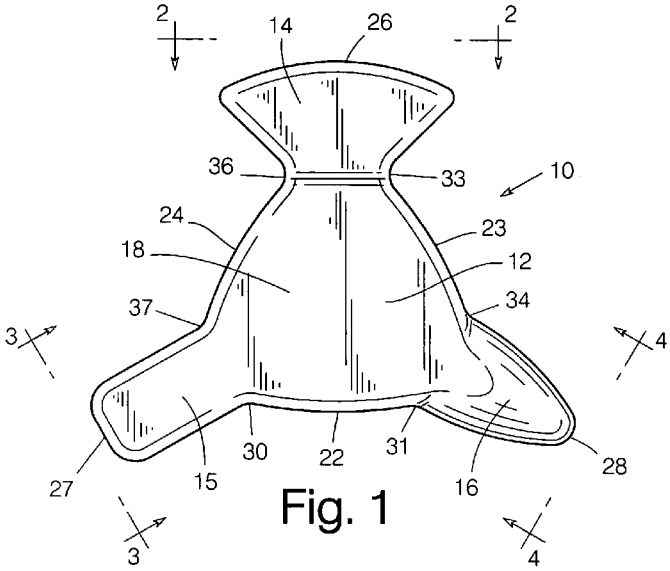
FIG. 1 is a top elevational view of a massage tool constructed in accordance with the present invention.

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring now to the drawings in greater detail, there is illustrated in FIGS. 1-6, a one-piece, handheld massage tool, generally designated 10, for applying a localized force and/or pressure constructed in accordance with the present invention.

The massage tool 10 is integrally formed and includes a central hub, or body portion 12, and three contact elements 14, 15 and 16 circumferentially spaced about the body portion 12 and extending radially outward from this junction so as to generally form a three-legged star shape. The generally triangularly-shaped body portion 12 is defined by spaced, generally smooth top and bottom surfaces 18 and 19, respectively, joined by connecting side edge surfaces defined by shoulder segments 22, 23 and 24. Note that the terminology top, bottom and side is used herein for convenience of description and not as a limitation. The contact element 22, 23 and 24 each extend along a radially-extending linear contact axis and have a proximal end coupled to the body portion, a length, or leg, and a free distal end, the outward ends of which define respective massage surfaces 26, 27 and 28 which can be selectively placed in contact with a therapy recipient. It should be understood that the common intersection of the proximal ends of the contact element define the tool's hub, or body portion 12.

The generally Y-shaped massage tool 10 shown herein includes the use of three different types of massage contact elements so that it is radially asymmetrical. In the illustrated embodiment, the first contact element 14 is in the shape of a wedge, the second contact element 15 is in the shape of a wide blunt or broad point, and the third contact element 16 is in the shape of a narrow point. The presence of three types of contact elements in the same tool enables the tool to be multi-functional and used for a wide variety of therapeutic techniques. It is generally intended that one contact element is applied to the recipient at any one time without contact of any of the other contact elements.

Figure 2:
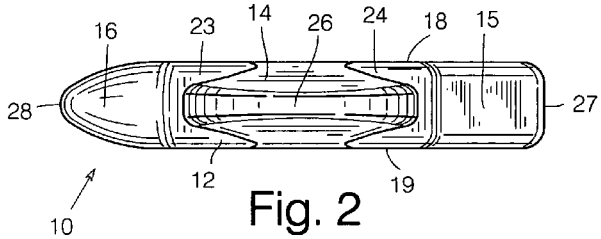
FIG. 2 is a side elevational view of the massage tool shown in FIG. 1 taken along line 2-2 and looking radially inward along the axis of the wedge contact element.
Figure 3:
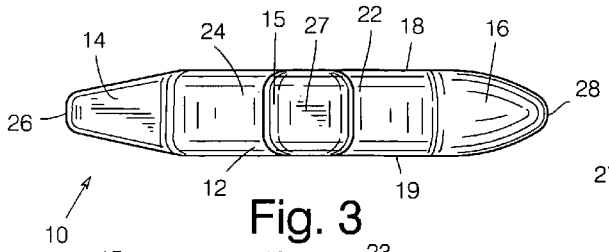
FIG. 3 is a side elevational view of the massage tool shown in FIG. 1 taken along line 3-3 and looking radially inward along the axis of the broad point contact element.
Figure 4:
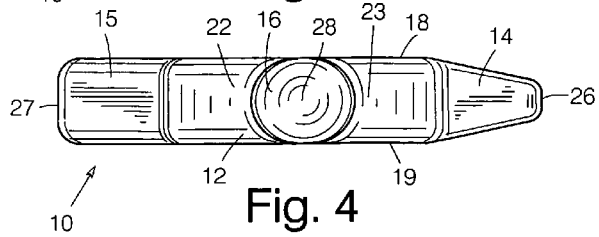
FIG. 4 is a side elevational view of the massage tool shown in FIG. 1 taken along line 4-4 and looking radially inward along the axis of the narrow point contact element.

As seen in FIGS. 1 and 2, the wedge element 14 is coupled to the body portion 12 at its proximal end with the top and bottom flattening and the sides narrowing as it extends away from the body portion 12 and then widening with the edges thickening slightly near its arcuate distal end surface 26, which has an approximate width of 1½ inches or so. As seen in FIGS. 1 and 3, the dull or broad point element 15 has a generally uniform square cross-section approximately ⅝ inch square over the majority of its length and terminates in a generally flat distal end surface 27. As seen in FIGS. 1 and 4, the sharp or narrow point element 16 has an oval cross-section at its proximal end adjacent the body portion 12, the width being slightly greater than the height, gradually tapers to a circular cross-section having a diameter of approximately ⅝ inch and then to a generally smooth rounded point at its distal end surface 28.

Generally, the broad point 15 and the narrow point 16 are generally sized and shaped to roughly mimic a human thumb, or perhaps a finger or knuckle, and are used to provide trigger point therapy, acupressure and reflexology, the narrow point 15 being advantageous for acute trigger point therapy. The wedge 14 is in the shape of a paddle, which tends to be flatter and wider, and which is well suited for providing cross fiber friction, muscle stripping, as well as other therapeutic techniques. One exemplary wedge type contact element is illustrated herein and another is further described in Louis, U.S. Pat. No. 6,267,738, the disclosure of which is hereby incorporated by reference. Two exemplary point type contact elements are illustrated herein and others are further described in Louis, U.S. Pat. No. 6,267,738 and in my pending U.S. patent application entitled "Massage Tool for Applying Localized Pressure," published Dec. 9, 2004 as Publication No. US2004/0249324A1, the disclosure of which is hereby incorporated by reference.

Figure 6:
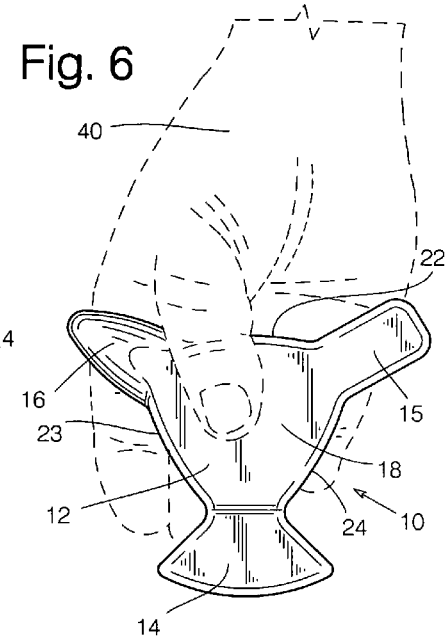
FIG. 6 is a view of the massage tool shown in FIG. 1 being gripped by the hand of a user, which is shown in phantom.
Figure 5:
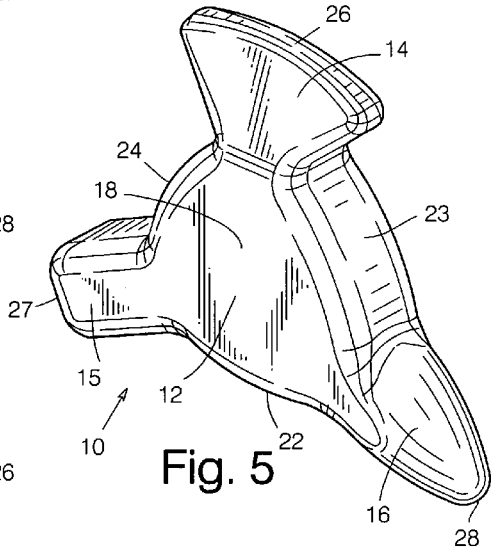
FIG. 5 is a perspective view of the massage tool shown in FIG. 1.

The circumferentially-spaced arcuate shoulder segments 22, 23 and 24 are disposed outward of and connect the top and bottom surfaces 18 and 19, one between each respective pair of adjacent contact elements 14, 15 and 16. Each shoulder segment 22, 23 and 24 is respectively located to intersect and be transverse to the extending axis of the contact element on the diametrically opposite side of the body 12. Opposite the wedge contact element 14 between broad and narrow point contact elements 15 and 16 is arcuate shoulder 22 which merges smoothly into the contact elements 15 and 16 by means of concave curves 30 and 31 at their respective junctions. Opposite the broad point contact element 15 between the and wedge and narrow point contact elements 14 and 16 is arcuate shoulder segment 23 which merges smoothly into the contact elements 14 and 16 by means of concave curves 33 and 34 at their respective junctions. Opposite the narrow point contact element 16 between the wedge and blunt point contact elements 14 and 15 is arcuate shoulder segment 24 which merges smoothly into the contact elements 14 and 15 by means of concave curves 36 and 37 at their respective junctions. As a result of this construction, the user can grip the massage tool 10 by holding the top and bottom surfaces 18 and 19 of the body portion 12 as seen in FIG. 6 and apply pressure to a selected one of the contact elements by pushing down on the associated shoulder segment with the palm, with the heel of the hand, or with the joint area between the thumb and forefinger.

The contact axes, which are coplanar and non-parallel, are angularly spaced 120° apart and pass through a common point in the mid-section of the body portion 12. The contact elements 14, 15 and 16 being disposed along their respective axes are configured to have a relatively similar mass so that the tool 10 is generally balanced with the center of mass of the tool lying near the center of the body portion 12. If left unbalanced, the user would have to compensate by applying adjusting pressure to the tool body or to the contact elements.

The massage tool 10 is approximately 3 inches wide and ⅝ inch thick with the contact elements 14, 15 and 16 extending radially outward from the corners of the body 10 approximately 1 inch. The massage tool 10 is generally hand-sized with the body portion generally palm-sized, but its size and that of the various parts can be varied to suit the particular needs of the massage therapist or user in holding the tool and placing his fingers about or around the various tool elements. The length of the respective side shoulders 22, 23 and 24 are approximately 2 times the width of the proximal ends of the contact elements. One skilled in the art will readily appreciate that the contact element may take other possible forms and/or different combinations could be combined at the tool ends. It might also be possible to arrange more than 3 contact elements in a single tool. For example, a tool with an odd number of circumferentially spaced contact elements may have an opposed shoulder segment where a user can grip and apply pressure to a particular contact element along a contact axis.

In addition, all of the parts of the tool are smoothly contoured with curved surfaces being provided where they intersect and all of the edges are rounded over with appropriate small radii to allow the tool to be held without encountering any uncomfortable sharp edges and ease the fatigue of the therapist and enhance the natural feel of the tool by the therapy recipient. Further, the arcuate shoulder segments 22, 23 and 24 are slightly curved to fit the palm of the hand 40 as best seen in FIGS. 1 and 6. While not illustrated herein, it is contemplated that the top and bottom surfaces 18 and 19 are flat, they may be slightly arcuate or may be shaped or molded to closely fit the hand of the therapist if deemed desirable.

In the illustrated embodiment, the surface of a shoulder segment 22, 23 and 24 can readily accommodate receipt of the user's palm or the space between the thumb and forefinger. The space between adjacent contact elements 14, 15 and 16 is sized and spaced to receive the hand and/or fingers of a user. The user can either let the weight of the tool apply pressure or the user can apply additional pressure to the shoulder segment so that the opposing contact element is urged into contact with a therapy recipient. In the case illustrated in FIG. 6, the wedge 14 is manipulated by applying pressure to the shoulder segment 22. In addition, the massage tool 10 can be tilted, turned, twisted or otherwise rotated by the user as desired by appropriate pressure applied to the sides of the body portion 12 or to either of the adjacent tool contact elements, or the legs thereof.

In at least the illustrated embodiment, a substantial portion of the mass of the massage tool 10 is largely comprised of one or more base materials used to form the various elements of the massage tool so as to make the tool hard, rigid and less prone to breakage. In at least one embodiment the base material is comprised of iron, which adds significantly to the weight of the tool 10. However one skilled in the art will readily appreciate that other materials could be used. In the illustrated embodiment, the overall mass of the tool is approximately 0.75 pound, but can vary. One possible weight range includes an overall weight as low as 0.25 pound and an overall weight as high as 5 pounds or more.

In at least one embodiment, the one or more base materials, which are relatively stiff, are coated with a layer of elastomeric material, plastic, or other smooth non-abrasive material, such as a plastic sold under the trade name Plastisol by Vynaflex Co. In addition to providing a smooth surface which can be readily cleaned or sanitized, the coating can provide insulative characteristics that reduces the conduction of heat. Additionally, the coating can act as a protective barrier against rust in the materials forming at least a part of the base materials. Still further, the plastic when applied can readily adapt to shapes and sizes, which might vary. Although the plastic coating is resilient, it is a relatively thin coating so that the tool is rigid and substantial pressure cannot be applied to the tool without much deformation from its original shape.

The orientation of the shoulder segments 22, 23 and 24 relative to their respective contact axes enables the massage tool 10 to be gripped in a fashion where the contact axis proximately extends along the arm of the user. This allows any force supplied and/or supported by the user to come from the arm of the user along the axis of a straightened arm, as opposed to needing to be largely generated and/or supported by the user's wrist. It is noted that since the tool 10 is relatively heavy, a significant portion of the force is due to gravity acting on the tool's overall mass.

In some instances the weight of the massage tool 10 will be sufficient to produce the desired pressure, thereby enabling the user to more readily focus on placement and positioning. Alternatively, the pressure produced by the tool 10 can be supplemented with an exerted force. Even where the weight of the tool 10 is deemed insufficient for producing the desired pressure, the weight of the tool 10 can have the effect of providing at least a portion of the desired pressure, thereby reducing the amount of force that needs to be applied by the user.

INDUSTRIAL APPLICABILITY

It should be apparent the massage tool described herein is a simple, multifunctional tool which is compact and inexpensive, yet is effective and easy to use.

Other aspects, objects and advantages of this invention can be obtained from a study of the drawings, the disclosure and the appended claims.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A massage tool comprising:

a generally triangularly-shaped body portion having three corners and being approximately palm-sized;

three contact elements of approximately equal length spaced circumferentially around said body portion, a contact element extending radially outward from each respective corner of said body portion;

said body portion being defined by spaced top and bottom surfaces and three circumferentially spaced side shoulder segments, one shoulder segment extending between each pair of adjacent contact elements and connecting said top and bottom surfaces;

a first of said contact elements being disposed along a first linear axis and having a distal end spaced from said body portion defining a narrow point adapted for engaging a recipient of therapy, a proximal end coupled to said body portion, and a leg therebetween of predetermined length;

a second of said contact elements being disposed along a second linear axis circumferentially spaced from said first contact element and having a distal end spaced from said body portion defining a broad point adapted for engaging a recipient of therapy, a proximal end coupled to said body portion, and a leg therebetween of predetermined length;

a third of said contact elements being disposed along a third linear axis circumferentially spaced from said first and second contact elements and having a distal end spaced from said body portion defining a wedge adapted for engaging a recipient of therapy, a proximal end coupled to said body portion, and a leg therebetween of predetermined length;

said contact axes generally being co-planar, extending radially from said body portion corners within the length of legs between said proximal and distal ends of their respective contact elements and spaced at substantially equal angles to one another;

the first of said shoulder segments extending between said second and third contact elements and configured to receive the hand of a user, said first segment being transverse to and intersecting said first axis and has a length between the proximal ends of adjacent contact elements greater than the width of the proximal end of said non-adjacent contact element to enable a user to hold and manipulate said first contact element;

the second of said shoulder segments extending between said first and third contact elements and configured to receive the hand of a user, said second segment being transverse to and intersecting said second axis and has a length between the proximal ends of adjacent contact elements greater than the width of the proximal end of said non-adjacent contact element to enable a user to hold and manipulate said second contact element;

the third of said shoulder segments extending between said first and second contact elements and configured to receive the hand of a user, said third segment being transverse to and intersecting said third axis and has a length between the proximal ends of adjacent contact elements greater than the width of the proximal end of said non-adjacent contact element to enable a user to hold and manipulate said third contact element;

the tool having an inner core formed with at least one relatively rigid and heavy base material and an outer surface formed from a coating material selected from the group consisting of plastics and elastomerics; and, the tool having a weight exceeding 0.25 pound.

* * * * *